US008763848B2

(12) United States Patent
Carey

(10) Patent No.: US 8,763,848 B2
(45) Date of Patent: Jul. 1, 2014

(54) CONTAINER FOR A TAILGATE PARTY

(75) Inventor: Brian Carey, Oceanside, NY (US)

(73) Assignee: BF Gate Mate Inc., Tuckahoe, NY (US)

( * ) Notice: Subject to any disclaimer, the term of this patent is extended or adjusted under 35 U.S.C. 154(b) by 0 days.

(21) Appl. No.: 13/468,210

(22) Filed: May 10, 2012

(65) Prior Publication Data

US 2012/0292327 A1 Nov. 22, 2012

Related U.S. Application Data

(60) Provisional application No. 61/519,294, filed on May 20, 2011.

(51) Int. Cl.
*B65D 81/38* (2006.01)
*A47B 88/04* (2006.01)
*B65D 21/02* (2006.01)

(52) U.S. Cl.
USPC ..... 220/592.2; 220/23.88; 220/505; 220/528; 248/917; 206/701

(58) Field of Classification Search
CPC ..... B65D 81/38; B65D 21/02; A47B 88/04; F25D 3/08
USPC ..... 220/505, 528, 592.2, 23.88; 206/541, 206/542, 545, 320, 722, 724, 701, 453, 206/586; 62/457.7; 248/917, 680, 681, 488, 248/213.2, 500, 316.5, 220.1, 451–453
See application file for complete search history.

(56) References Cited

U.S. PATENT DOCUMENTS

| | | | | | |
|---|---|---|---|---|---|
| 2,185,084 | A * | 12/1939 | Hutaff, Jr. | 248/488 |
| 3,052,508 | A * | 9/1962 | Fink | 312/404 |
| 3,591,768 | A * | 7/1971 | Torres | 219/387 |
| 3,791,547 | A * | 2/1974 | Branscum | 220/592.2 |
| 4,037,081 | A * | 7/1977 | Aldridge et al. | 219/387 |
| 5,005,679 | A * | 4/1991 | Hjelle | 190/110 |
| 5,575,401 | A * | 11/1996 | Trower et al. | 220/522 |
| 5,816,433 | A * | 10/1998 | Higgins | 220/534 |
| 6,269,965 | B1 * | 8/2001 | White et al. | 220/592.18 |
| 6,481,239 | B2 * | 11/2002 | Hodosh et al. | 62/457.4 |
| 6,491,268 | B1 * | 12/2002 | Channer et al. | 248/176.1 |
| 6,585,212 | B2 * | 7/2003 | Carnevali | 248/346.07 |
| 7,188,491 | B2 * | 3/2007 | Donald et al. | 62/457.7 |
| 7,284,393 | B1 * | 10/2007 | Macmillan | 62/457.7 |
| 7,780,034 | B1 * | 8/2010 | Richardson | 220/592.18 |
| 7,806,376 | B2 * | 10/2010 | Song et al. | 248/177.1 |
| 2004/0016673 | A1 * | 1/2004 | Kovich | 206/542 |
| 2004/0262319 | A1 * | 12/2004 | Fisher | 220/592.03 |
| 2011/0284555 | A1 * | 11/2011 | Barringer et al. | 220/592.01 |

* cited by examiner

*Primary Examiner* — Andrew Perreault
(74) *Attorney, Agent, or Firm* — F. Chau & Associates, LLC

(57) ABSTRACT

An apparatus is configured to provide storage and includes a container having an opening, a panel, a plurality of bins, and a cover. The panel has at least one through-hole. The perimeter of the panel is larger than the perimeter of the opening of the container. Each bin has an opening, and each bin is configured to be received by a corresponding one of the through-holes of the panel. The cover is attached to the container. The apparatus may be used to transport food and other items needed for a tailgate party.

9 Claims, 7 Drawing Sheets

CONTAINER FOR A TAILGATE PARTY

CROSS-REFERENCE TO RELATED APPLICATIONS

This application claims the benefit of U.S. Provisional Application No. 61/519,294 filed on May 20, 2011, which is incorporated by reference in its entirety herein.

TECHNICAL FIELD

The present disclosure relates generally to a container used to support outdoor cooking and eating, and more particularly to a container used to support cooking and eating, which is configured to be transported by a vehicle.

DISCUSSION OF RELATED ART

Tailgate parties ("Tailgating") have increased in popularity around the United States. Tailgating often involves using the tailgate of a pickup truck as the table for preparing food and beverages at a large social event, such as a sporting event. For example, foods that can be barbequed are popular at tailgating and other events. However, it can be difficult to organize and transport condiments, seasonings, utensils (e.g., cups, plates, etc.), and food to the event. Thus, there is a need for a convenient and easily transportable container that can be used at an outdoor event.

SUMMARY

According to an exemplary embodiment of the invention, an apparatus is provided that is configured to provide storage. The apparatus includes a container having an opening, an insert configured to fit within the opening, and a cover connected to the container via a hinge. The insert includes a plurality of recessed volumes for storing items. At least one of the recessed volumes is configured to insulate against heat.

According to an exemplary embodiment of the invention, an apparatus is provided that is configured to provide storage. The apparatus includes a container with an opening, a panel including at least one through-hole, a plurality of bins, and a cover. The perimeter of the panel is larger than the perimeter of the opening of the container. Each bin has an opening, and each bin is configured to be received by a corresponding one of the through-holes of the panel. The cover is attached to the container.

According to an exemplary embodiment of the invention, an apparatus is provided that is configured to provide storage. The apparatus includes a container with an opening, a rigid panel, first though third bins, and a cover. The rigid panel includes a row of first through third through-holes. A lip of the panel entirely overlaps a perimeter edge of the container around the opening. The third through-hole is located between the first and second holes. The first bin is located in the first through-hole and suspended via an overlap of a lip of the first bin and an area of the panel surrounding the first through-hole. The second bin is located in the second through-hole and suspended via an overlap of a lip of the second bin and an area of the panel surrounding the second through-hole. The third bin is located in the third through-hole and suspended via an overlap of a lip of the third bin and an area of the panel surrounding the third through-hole. The third bin is configured to insulate food against heat. The cover attached to the container.

According to an exemplary embodiment of the invention, an apparatus is provided that is configured to provide storage.

The apparatus includes a container, a panel, several bins, and a cover. The container includes an opening and a well. The panel includes a first set of through-holes, a second set of through-holes, and a third through-hole. The third through-hole is located between the first and second sets. An outer perimeter of the panel is larger than an outer perimeter of the container. A depth of each bin is configured to fit within a depth of the well. One of the bins is a cooler bin that is configured to insulate food against heat. The cover is attached to the container via a hinge.

In an embodiment, a top surface of the cover has a first recessed portion and a bottom surface of the cover has a second recessed portion.

In an embodiment, the apparatus further includes a removable tray that is entirely located within the first recessed portion and a handle that is attached to the second recessed portion.

In an embodiment, depths of at least two of the bins differ from one another.

In an embodiment, the apparatus further includes a cutting board, wherein the tray includes a pair of guide tracks, and the cutting board is configured to be received by the cutting board.

Each of the above-described apparatuses may be used to transport food and other items needed for a tailgate party.

BRIEF DESCRIPTION OF THE DRAWINGS

Exemplary embodiments of the invention can be understood from the following descriptions in conjunction with the accompanying drawings, in which.

DETAILED DESCRIPTION

Exemplary embodiments of the present invention will be described below in more detail with reference to the accompanying drawings. This invention may, however, be embodied in different forms and should not be construed as limited to the embodiments set forth herein.

Figure 1:
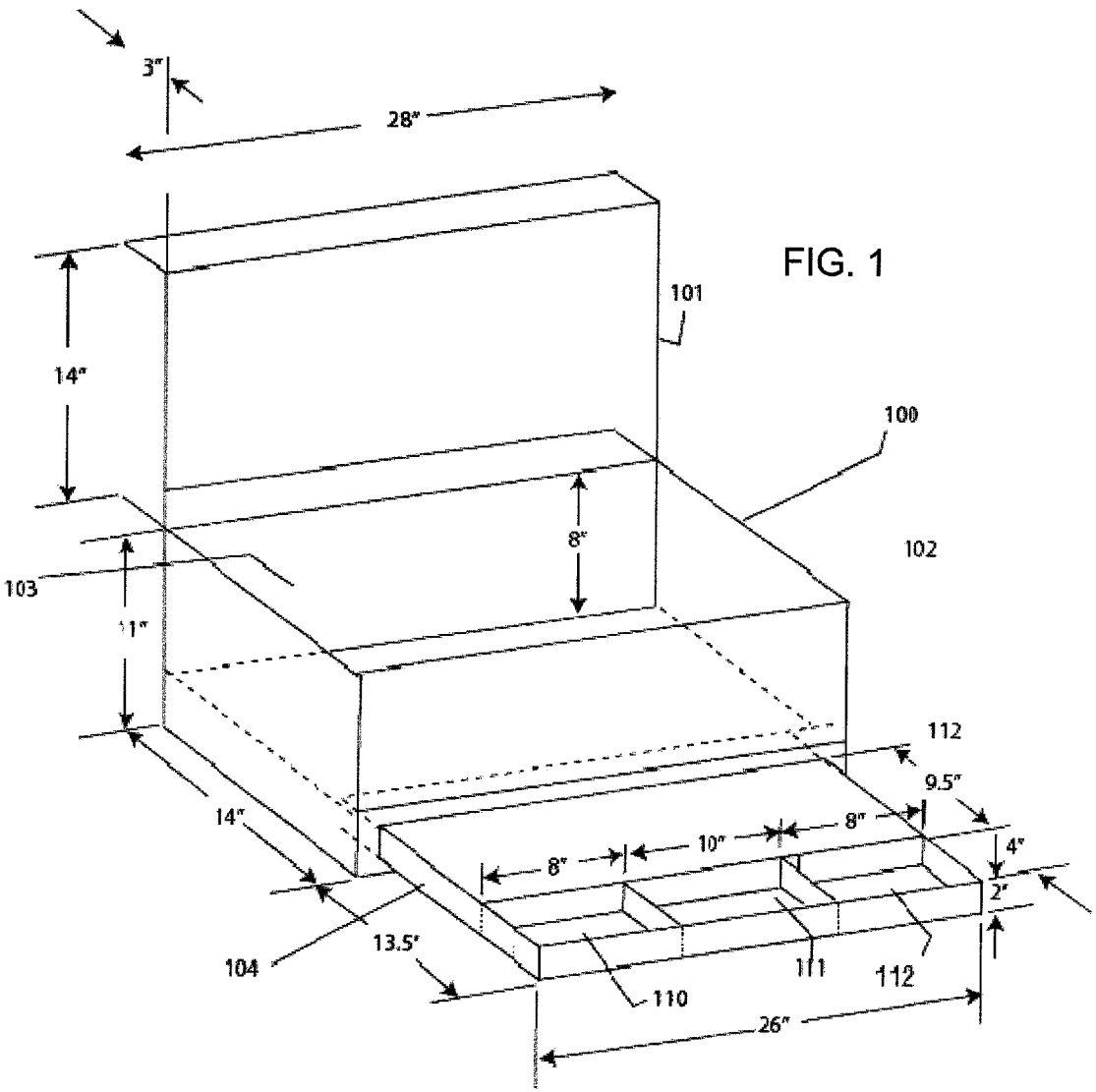
FIG. 1 illustrates a container that can be used at a Tailgate Party according to an exemplary embodiment of the invention.

FIG. 1 illustrates a view of a container (e.g., a toolbox) in an open position according to an exemplary embodiment of the invention, which can be used at a tailgate party. The container 100 has a cover 101, and a main housing 102 including a main compartment 103 and a drawer 104. As will be discussed later, the main compartment 103 contains an insert for storing various items, which may be used for outdoor cooking. In an exemplary embodiment, the insert is plastic (e.g., thermoplastic) and is manufactured using injection molding. Injection molding is a manufacturing process that may be used to produce parts from thermoplastic and thermoplastic materials. The drawer 104 is subdivided into various compartments 110, 111, and 112, which provide convenient storage for various items. Compartment 110, for example, can be used to store cooking utensils such as a spatula, fork, carving knife, tongs and lighter. Compartments 111 and 112 can be used for heavy duty steak knives, forks and spoons.

While the drawer 104 has been described as including three compartments, exemplary embodiments of the drawer are not limited to any particular number of compartments. For example, alternate embodiments of the drawer 104 may contain less than three compartments or more than three compartments.

While FIG. 1 illustrates various dimensions for the cover 101, main housing 102, and drawer 104, and compartments 110-112, the invention is not limited thereto. For example, any of the illustrated heights, widths, lengths, and depths may be altered as necessary. In an exemplary embodiment, compartment 111 is wider than compartments 110 and 112. In an exemplary embodiment, compartments 110 and 112 have a same width. While FIG. 1 illustrates drawer 104 having one row of compartments, in alternate embodiments of the invention, additional rows of compartments may be present. A compartment that holds heavier utensils may be configured to have thicker sides and/or include a scratch resistant coating.

Figure 2:
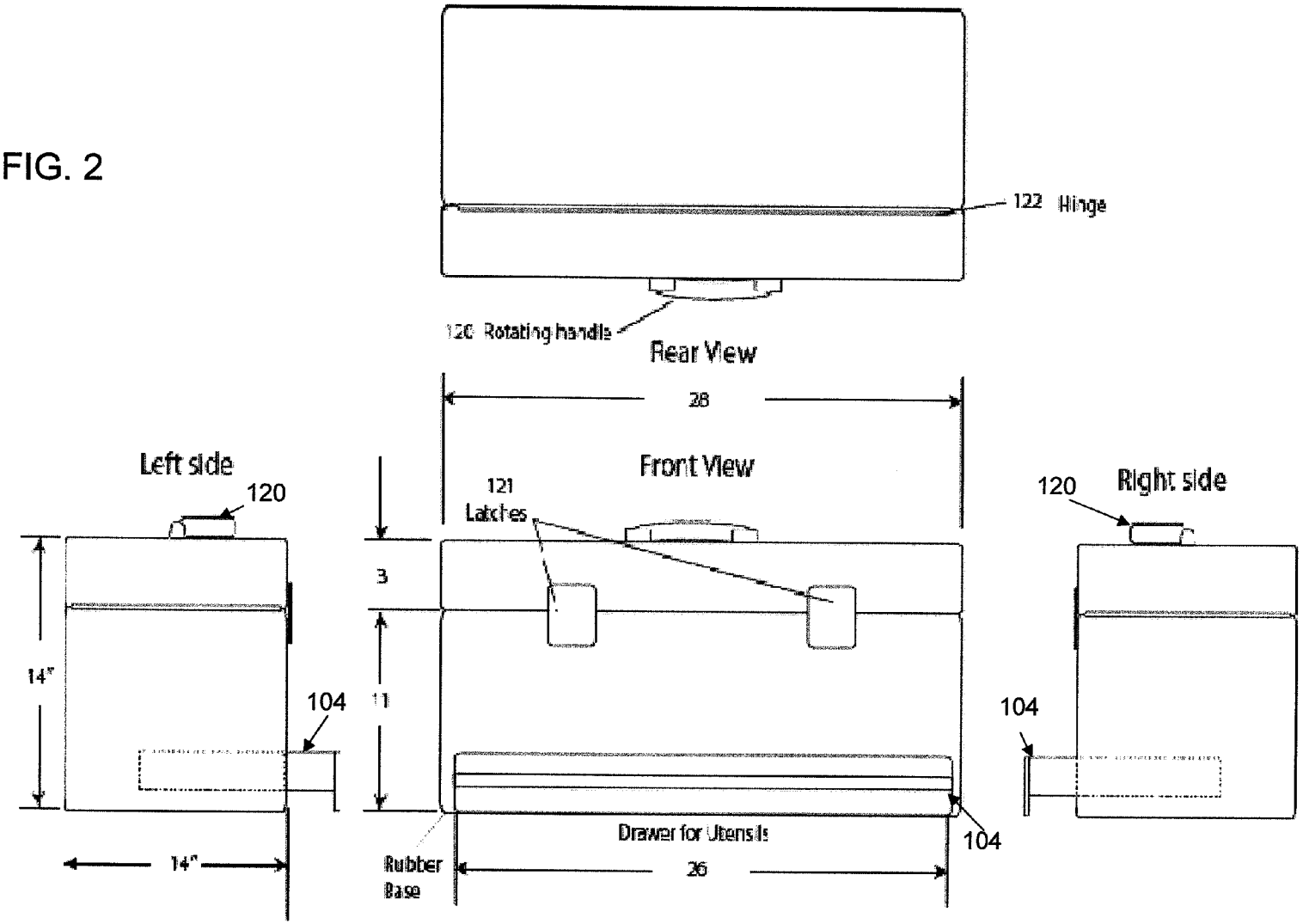
FIG. 2 illustrates various views of the container.

FIG. 2 illustrates various views of the container 100 in a closed position according to an exemplary embodiment of the invention. The cover 101 has a handle 120. In an embodiment, the handle 120 is clamped to the top of the cover 101 and can be rotated back and forth to be flush with opposing areas of the cover 101. The cover 101 is secured in a closed position with latches 121. While FIG. 1 illustrates uses of two latches 121, a single latch may be present in an alternate embodiment. In an embodiment, cover 101 is attached to the main body 102 with a hinge 122 (e.g., a barrel hinge, pivot hinge, case hinge, etc). In an embodiment, the container 100 is made of strong polymer plastic for durability and longevity. In an embodiment, the handle 120, cover 101, hinge 122, and latches 121 are also made of durable materials. In an embodiment, the bottom of the main body 102 includes a rubber coating or rubber footings that enable a user to place the container on top of a vehicle (e.g., car, truck, etc.) or a table to prevent slipping, sliding or condensation. While FIG. 2 illustrates various dimensions, embodiments of the invention are not limited thereto. For example, illustrated heights and widths may be altered as necessary.

Figure 3:
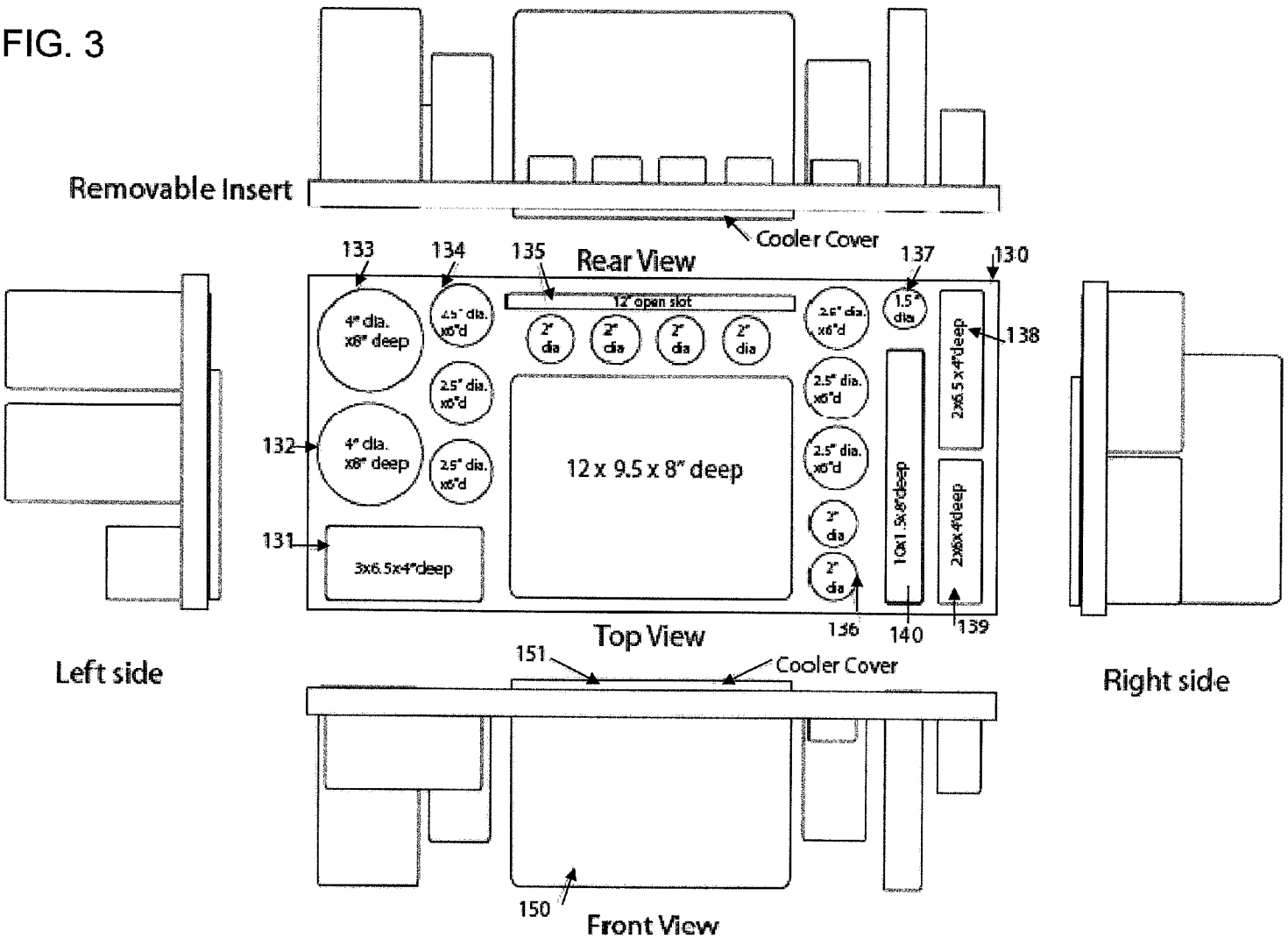
FIG. 3 illustrates an insert for a compartment of the container according to an exemplary embodiment of the invention.
Figure 4:
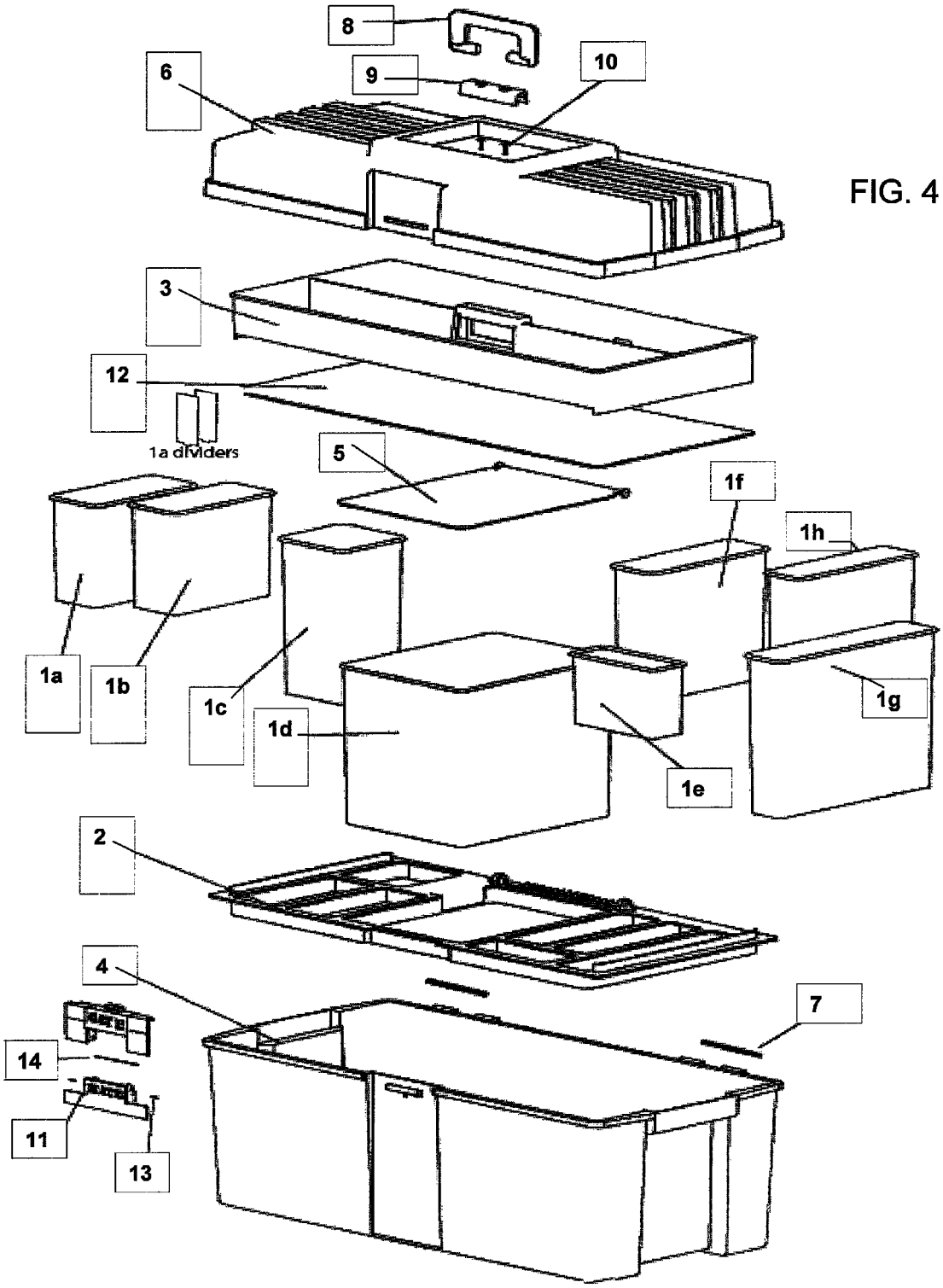
FIG. 4 illustrates a view of constituent parts of the container according to an exemplary embodiment of the invention.

FIG. 3 illustrates an insert 130 that is configured for the main compartment 103 according to an exemplary embodiment of the invention. The insert 130 may be injection molded. The insert 130 has recessed volumes or receptacles 131, 132, 133, 134, 135, 136, 137, 138, 139 and 140 of various convenient sizes to store, for example, plates, bowls, cutlery, cups, spices, condiments, napkins, toothpicks, etc. In an embodiment, the recessed volumes are an integral part of the insert 130 and cannot be removed. The recessed volumes may also be referred to as well. The bottom surface of the wells may be configured to be substantially flat. When the recessed volumes are removable, they may be referred to a receptacles or bins. The insert 130 also has a centrally located cooler area 150 with a cover 151. The cooler area 150 may be used, for example, to store cheese, shrimp, cold cuts, and meat to be grilled. The cooler area 150 may be part of the insert 130 (e.g., a recessed volume) or a removable receptacle. The insert 130 is removable for easy cleaning and restocking. As shown in FIG. 4, the depths of the recessed volumes or the receptacles may differ from one another. The recessed volumes or the receptacles may have various shapes such as circular, square, rectangular, etc. In an embodiment, the cooler area 150 is surrounded on all sides by the recessed volumes or the receptacles, configured to be thicker than the other receptacles, or include an insulating liner (e.g., neoprene) for insulating food. While FIG. 3 illustrates the area around the cooler area 150 having a predetermined number of recessed volumes or receptacles, with particular shapes and sizes, the invention is not limited thereto. For example, any number of recessed volumes or receptacles, with any shape and size may be located in the area. In an alternate embodiment, an area in front of the cooler 150 also includes recessed volumes or receptacles. Further, while FIG. 3 illustrates specific dimensions for each of the recessed volumes or the receptacles, the invention is not limited thereto. For example, in alternate embodiments, the depths, lengths, widths, diameters of the recessed volumes and the receptacles may be altered as necessary. In an embodiment, openings of the recessed volumes are level with one another about the insert 130.

In an exemplary embodiment, a logo (e.g., of an athletic team) is affixed to the outside of the container. In such instance, embodiments of the invention may be marketed in conjunction with that team. The container may be referred as a Tailgate Party Toolbox. The container may be sold with various items already included within its receptacles. Marketing may also be done in conjunction with one or more manufacturers of the items included.

FIG. 4 illustrates a view of constituent parts of the container according to an exemplary embodiment of the invention. Referring the FIG. 4, the container includes a bin group 1 including bins 1*a*, 1*b*, 1*c*, 1*d*, 1*e*, 1*f*, 1*g*, 1*h*, a bin panel 2, a utensil tray 3, container bottom 4, a cooler top 5, a container top 6, top hinge pins 7, a handle 8, a handle clamp 9, handle clamp rivets 10, a lock assembly 11, a cutting board 12, a lock hinge pin 13, and a lock rivet 14.

While FIG. 4 illustrates the bin group having 8 bins, the invention is not limited thereto. For example, there may be a lesser or greater number of bins. Further, while FIG. 4 illustrates the bins having rectangular shapes, the invention is not limited thereto. For example, the bins can be circular, elliptical, rectangular, conical in shape, etc. Further, the depths of each of the bins may vary. In the embodiment shown in FIG. 4, a first set of the bins (e.g., 1*a-c*) is located to the left of cooler bin 1*d*, and the remaining bins (e.g., 1*e-h*) are located to the right of the cooler bin 1*d*. Although not shown in FIG. 4, at least one of the bins may be fitted with at least one divider. For example, in one embodiment, bin 1*a* includes two dividers, which generates three sub-compartments for respectively storing forks, knives, and spoons. In an exemplary embodiment, bin 1*b* is used to store bowls, bin 1*c* is used to store cups, cooler bin 1*d* is used to store food, bin 1*e* is used to store spices, bin 1*f* is used to store condiments, bin 1*g* is used to store plates, and bin 1*h* is used to store napkins. However, this is merely an example, as each of the above-listed items may be substituted with another item. Each of the bins may be labeled for the item it is configured to store. Further, the depth of each bin may be configured to be suitable for holding the corresponding item.

The cooler bin 1*d* is configured to keep food or drinks cold. The cooler bin 1*d* may be thicker than the other bins or include insulating material to keep food cold. In an embodiment, the cooler top 5 is attached to one top edge of the cooler bin 1*d* to swing between open and closed positions. While FIG. 4 shows the cooler top 5 attached to the back top edge of the cooler bin 1*d*, in alternate embodiments it is attached to the left or right top edge. The cooler bin 1*d* may be located between two distinct sets of the bins so that weight can be more evenly distributed and to aid in insulating its contents. In an embodiment, the cooler top 5 is made of styrene (e.g., high-impact). The cooler bin 1*d* may be sized such that it extends substantially between front and back edges of the bin panel 2.

The bin panel 2 includes a number of openings or through holes, which are configured to receive the corresponding bins. The opening of a bin may have a lip that extends outward from the opening. When such a bin is dropped into an opening of the bin panel 2, this lip contacts a top area of the bin panel 2, which prevents the bin from dropping to the bottom of the container bottom 4. The bins that are not as deep as the container bottom 4 are essentially suspended by the bin panel 2. Thus, even though several bins have different depths, they will all rest at the same level. If the bins are placed into the container bottom 4 without using the bin panel 2, bins of different depths will be at different levels from one another. For example, shallow bins placed in the container bottom 4 can be difficult to access for certain users. Thus, use of the bin panel 2 enables bin panels of various depths to be easily and quickly accessed by all users. The bin panel 2 and its openings may be rigid. In an embodiment, the bin panel 2 is made of styrene (e.g., high impact). In an embodiment, the outer perimeter of the bin panel 2 has a lip. When the bin panel 2 is aligned with the opening of the container bottom 4 and dropped in, this lip contacts the outer perimeter top edges of the container bottom 4, which prevents the bin panel 2 from dropping to the bottom of the container bottom 4.

In an embodiment, the back top edge of the container bottom 4 includes a pair of hinges, where each hinge includes a hinge pin 7. In an embodiment, the container bottom 4 is made of polyethylene (e.g., high-density). An edge of the container top 6 is affixed to the hinges of the container bottom 4. In an embodiment, the container top 6 is made of polyethylene (e.g., high-density). The lock assembly 11 may include a lock hinge pin 13 and a lock rivet 14. The lock assembly 11 may be affixed to the container bottom 4. A logo may be affixed to the lock assembly 11.

In an embodiment, the handle 8 is affixed to the container top 6 by the handle clamp 9 and the handle clamp rivets 10. A spaced apart pair of the rivets 10 may be drilled into the top surface of the container top 6. The handle clamp 9 may include a pair of holes that correspond to the rivets 10. The handle 8 may be interfaced with the handle clamp 9, the handle clamp 9 may be placed over the rivets 10 by its holes, and then the handle 8 may be affixed by clamping sides of the handle clamp 9 to the rivets 10. The handle 8 can rotate relative to the top surface of the container top 6. The rivets 10 may be attached to a recessed portion of the top surface of the container top 6. The recessed portion may be configured to enable the handle 8 to be rotated such that it is flush with the recessed portion. In an embodiment, the hinge pins 7 and the lock hinge pin 13 have a zinc finish and are knurled on one end. In an embodiment, the handle clamp rivets 10 and the lock rivets 14 are stainless steel. In an embodiment, the lock assembly 11 is polyethylene (e.g., high density). In an embodiment, the handle 8 or the handle clamp 9 are made of polypropylene.

The bottom surface of the container top 6 may include a recessed portion that is deep and wide enough to receive the utensil tray 3. The bottom of the utensil tray 3 may have a pair of guide tracks to receive the cutting board 12. The thickness of the bin panel 2 may be configured to enable the utensil tray 3 to fit within the recess of the bottom surface of the container top 6 when the container top 6 is closed. The utensil tray 3 may have a divider. As an example, the tools used for barbequing may be placed in a compartment of the utensil tray 3.

Figure 5:
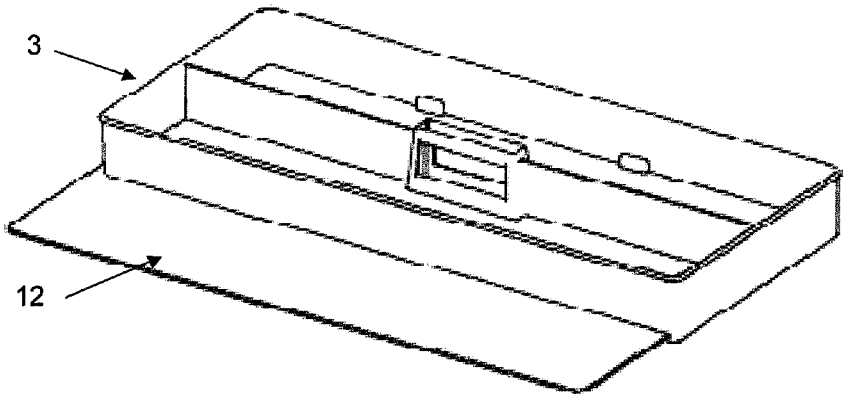
FIG. 5 illustrates a view of the container according to an exemplary embodiment of the invention where the constituent parts have been combined.
Figure 5:
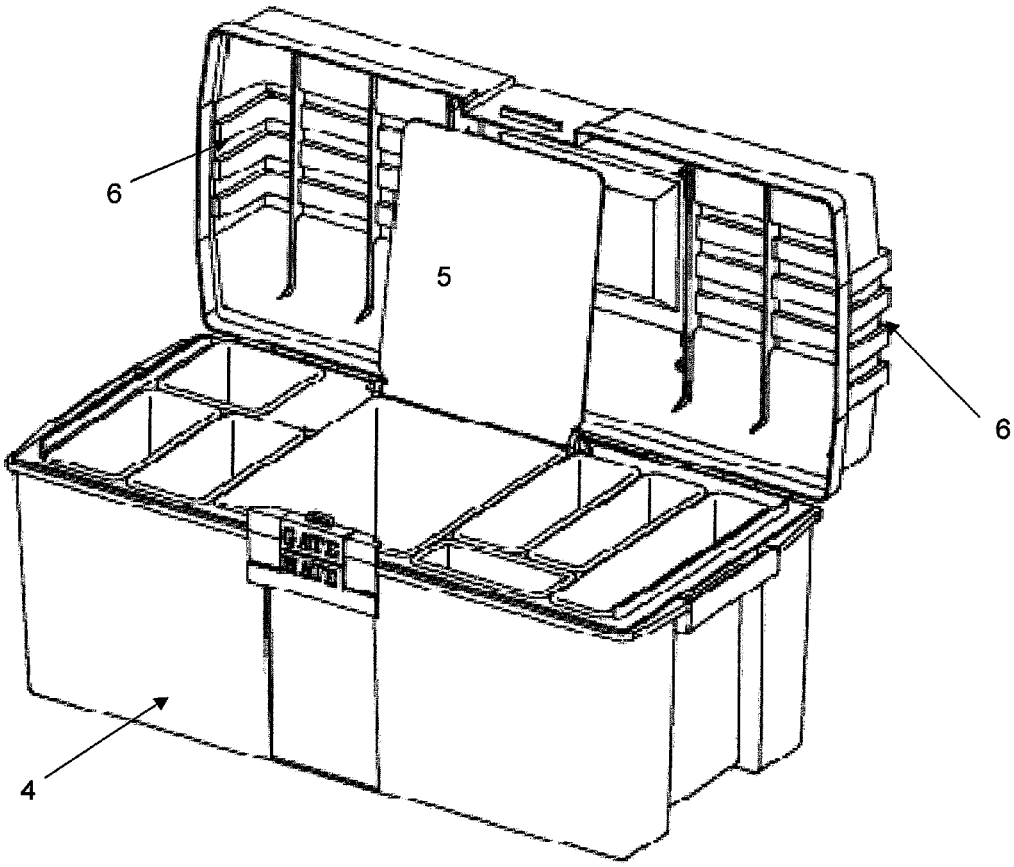

FIG. 5 illustrates a view of the container according to an exemplary embodiment of the invention where the constituent parts have been combined. As shown by FIG. 5, the utensil tray 3 is configured to be easily removed from the container. The utensil tray 3 is optional and may be omitted. In an embodiment, the cutting board is made of polyethylene (e.g., high density).

At least one embodiment of the container provides a convenient way to store and transport items used for a tailgate party or outdoor cooking.

In an exemplary embodiment of the invention, the cover 101 or container top 6 is configured to store an electronic device such as a tablet computer, a cellular phone, a personal digital assistant, electronic book (E-book), a laptop, or a music player (e.g., MP3 player, IPOD, etc.), etc. In an embodiment, clips are attached to the top surface of the cover 101 or the container top 6. When the clips are set to an open position, the device can be removed. When the clips are set to a closed position, they apply pressure to the device to hold the device and prevent its movement. In an embodiment, the clips are attached to guide tracks on the top surface of the cover of the container top 6, which allow the positions of the clips to be adjusted. For example, since devices have varying dimensions, the clips can be moved such that they correspond to corners or ends of the device that is to be restrained. In this way, multiple devices of different sizes can be restrained. In an embodiment, the guide tracks are in parallel with one another. In another embodiment, at least two of the guide tracks are configured to be moved closer to one another to accommodate smaller devices.

In an embodiment, a shock absorbing material (e.g., a shock absorbing polymer, a viso-elastic polymer, rubber, neoprene, silicone, a simple polymer, etc.) is affixed to the top surface, and the devices rest on top of the material.

In an embodiment, a stand is attached to the top surface of the cover 101 or the container top 6, which enables a tablet computer to be tilted between various viewing angles. For example, the stand enables tilting of the back edge of a tablet computer (or other reasonably flat device) to an angle that enables the device to be flush or perpendicular with the top surface, angles in between, and angles beyond perpendicular. In another embodiment, the stand further allows the device to be rotated to the left or right to enable various viewing angles.

Figure 6:
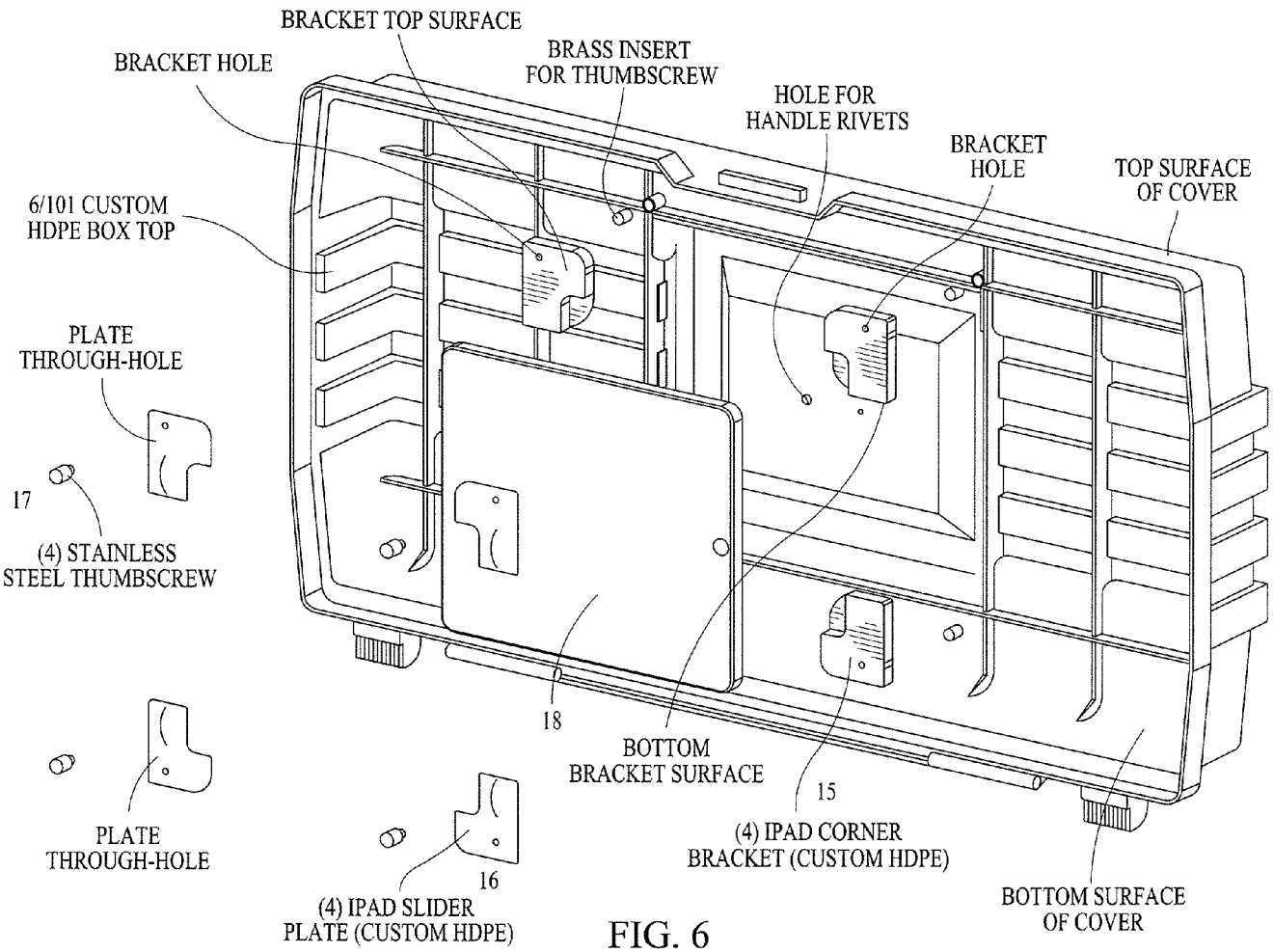
FIG. 6 illustrates an embodiment of the cover of the container being configured to secure an electronic device (e.g., a tablet computer)
Figure 7:
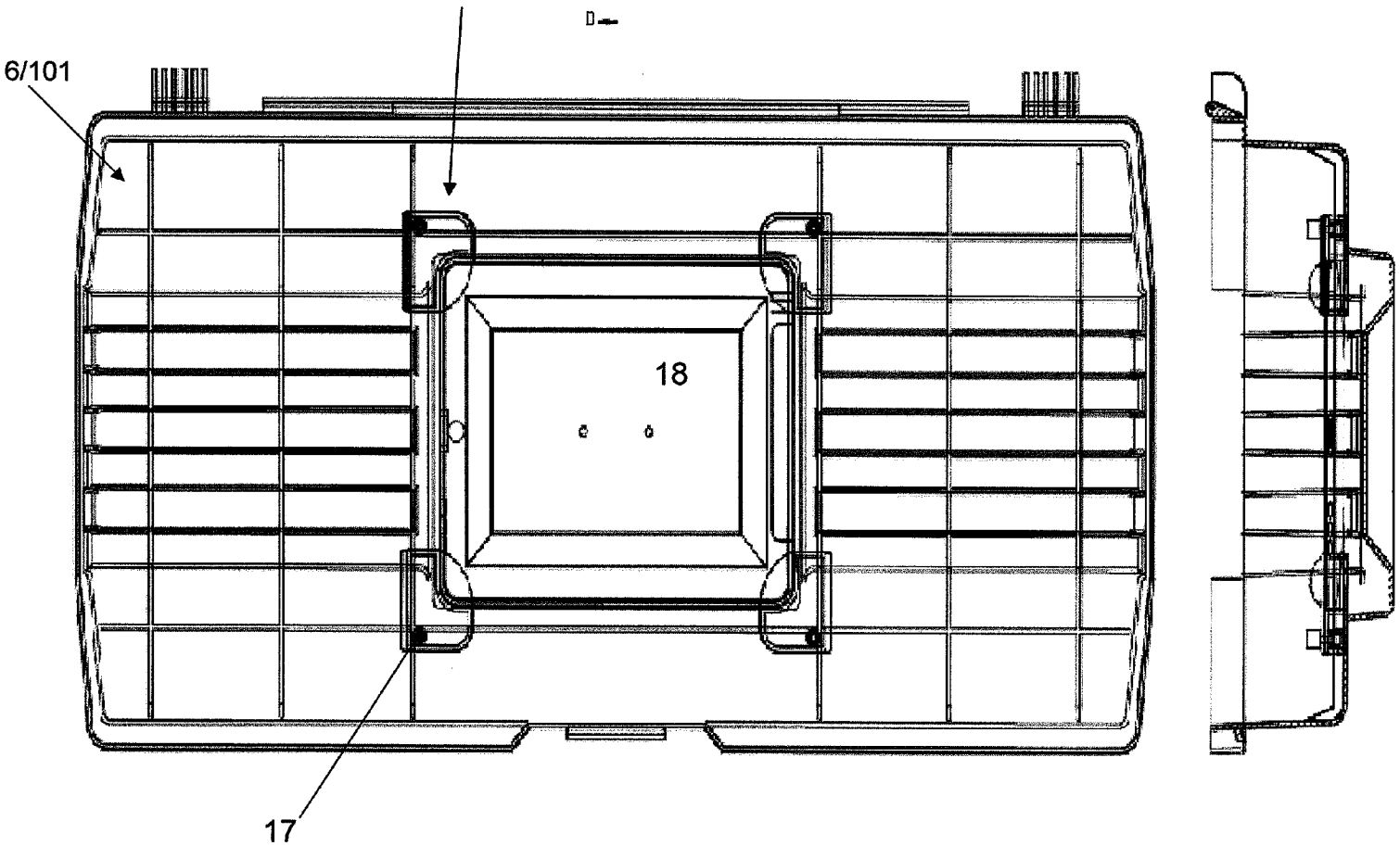
FIG. 7 illustrates views of the cover of FIG. 6.

FIG. 6 illustrates an embodiment of the cover of the container being configured to secure an electronic device (e.g., a tablet computer). Referring to FIG. 6, corner brackets 15 are mounted to a bottom surface of the cover 101 or the container top 6. Each bracket 15 has a curved depression or crevice. The corners of the device 18 can be placed into the corresponding crevices such that the device 18 is bounded on all sides by all of the brackets 15. Then, the device 18 is secured by affixing a slider plate 16 to each bracket 15. For example, the slider plates 16 may be affixed to a corresponding bracket using thumbscrews 17 (e.g., stainless steel). The slider plates 16 can be rotated outward to the left and to the right while still under friction. A slider plate 16 is initially screwed into a corresponding bracket 15 such that they are aligned with one another. However, if a left slider plate 16 on one edge of the device 18 is sufficiently rotated to the left away from its bracket 15 (e.g., 45, 90 degrees, etc.) and a right slider plate 16 on the same edge is sufficiently rotated to the right away from its bracket 15, the device 18 can be easily removed. A half round rib may be present that is pushed against to enable a plate 16 to be rotated outward. Stop ribs and ball bumps may be present to keep the slider plates 16 from moving to far. In an embodiment, the brackets 15 and slider plates 16 are made of polyethylene (e.g., high density). The left side of FIG. 7 illustrates a top-down view of the cover 6/101 where the device 18 has been mounted using the brackets 15 and slider plates 16. The right side of FIG. 7 illustrates a side view of the cover 6/101.

In embodiments, the container is configured to conform to widths of various automobile or truck trunks. The outer sides of the container may include retractable extensions that can be used to prevent the container from moving within the vehicle. For example, when the container is placed in the tailgate of a vehicle and empty space is present on one or more sides, an extension can be retracted until this space is filled. The extension can then be locked in place.

Although the illustrative embodiments have been described herein with reference to the accompanying drawings, it is to be understood that the present invention is not limited to those precise embodiments, and that various changes and modifications may be affected therein by one of ordinary skill in the related art without departing from the spirit and scope of the invention. Accordingly, all such changes and modifications are intended to be included within the scope of the disclosure.

What is claimed is:

1. An apparatus configured to provide storage, the apparatus comprising:

a container comprising a pair of side walls, a back wall, a front wall, a bottom wall, and an opening;

a panel including at least one through-hole, wherein the perimeter includes a lip that mates with edges of the side walls;

a plurality of bins, wherein each bin has an opening, and each bin is configured to be received by a corresponding one of the through-holes of the panel;

a cover that is attached to the back wall of the container via a hinge;

four screws;

four slider plates, wherein each plate includes a through-hole; and four brackets mounted to respective corners of a rectangular area on a bottom surface of the cover, wherein a same upper surface of each bracket includes a bracket hole, and for each bracket a corresponding one of the screws passes sequentially through the through-hole of a corresponding one of the plates and the bracket hole and screws into the bracket hole, wherein each bracket comprises a top bracket surface and a bottom bracket surface opposing, surrounding and larger than the top bracket surface, wherein the bottom bracket surface is in contact with the bottom surface of the cover, wherein a depth of the bracket within a first area of its top bracket surface is thicker than a depth of the bracket within a second area of the bottom bracket surface that excludes the first area, and wherein the bracket has a concave edge located between the first and second areas.

2. The apparatus of claim 1, wherein each bin includes a lip around its corresponding hole that is larger than the through-hole of the panel in which the bin is placed.

3. The apparatus of claim 2, wherein one of the bins is a cooler bin configured to insulate against heat.

4. The apparatus of claim 3, wherein the cooler bin includes an insulating liner.

5. The apparatus of claim 1, further comprising a removable tray that is configured to fit within a recess of the cover, and a cutting board that is configured to be received by a pair of guide tracks of the tray.

6. The apparatus of claim 1, wherein the concave edges of two of the brackets located on one diagonal of the rectangular area face one another, and the concave edges of the other two brackets face one another.

7. The apparatus of claim 1, wherein each plate has an area that surrounds and is larger than the top bracket surface of a corresponding bracket.

8. The apparatus of claim 7, wherein loosening the screw that passes through each plate enables the plate to be rotated about a rotational axis of the screw such that a bottom flat surface of the plate slides against a flat surface of the top bracket surface.

9. The apparatus of claim 8, further comprising a plurality of stop ribs that prevent each plate from moving beyond a predetermined rotational angle.

* * * * *